United States Patent [19]

Boehringer et al.

[11] 4,231,375

[45] Nov. 4, 1980

[54] PULMONARY EXERCISER

[76] Inventors: John R. Boehringer; John H. Lecky, both of Wynnewood, Pa.

[21] Appl. No.: 843,984

[22] Filed: Oct. 20, 1977

[51] Int. Cl.[3] ..... A63B 23/00

[52] U.S. Cl. ..... 128/725; 272/99; 235/90

[58] Field of Search ..... 128/2.08, 208, 725, 128/726, 718, 728, 719, 720; 272/99, DIG. 5; 73/209; 235/90

[56] References Cited

U.S. PATENT DOCUMENTS

| | | | |
|---|---|---|---|
| 800,812 | 10/1905 | Matson | 235/90 |
| 2,099,842 | 11/1937 | Connell | 73/209 |
| 2,254,259 | 9/1941 | Aller | 73/209 |
| 3,416,371 | 12/1968 | Locke | 73/209 |
| 3,720,202 | 3/1973 | Cleary | 272/99 |
| 3,754,546 | 8/1973 | Cooper | 272/99 |
| 3,863,914 | 2/1975 | O'Connor | 272/99 |
| 3,908,987 | 9/1975 | Boehringer | 272/99 |
| 4,025,070 | 5/1977 | McGill | 272/99 |
| 4,037,836 | 7/1977 | Puderbaugh | 272/99 |

*Primary Examiner*—Richard J. Johnson
*Attorney, Agent, or Firm*—Paul & Paul

[57] ABSTRACT

Pulmonary exerciser device is provided whereby in one embodiment respective inspiratory and expiratory stages are stacked, the former above the latter, in a generally vertical, elongated tubular chamber. The patient pulmonary system is coupled to an intermediate point, and respective balls are carried in the expiratory and inspiratory chambers. Patient inhalation raises the lower ball, and patient exhalation raises the upper ball. Indicia are provided for incentive motivation and measurement of inspiration flow rate. Inspiration only is provided in other devices with provision for measurement and recording. In other devices, expiratory exercise is provided, with or without inspiratory exercise.

10 Claims, 11 Drawing Figures

Fig. 7 PRIOR ART
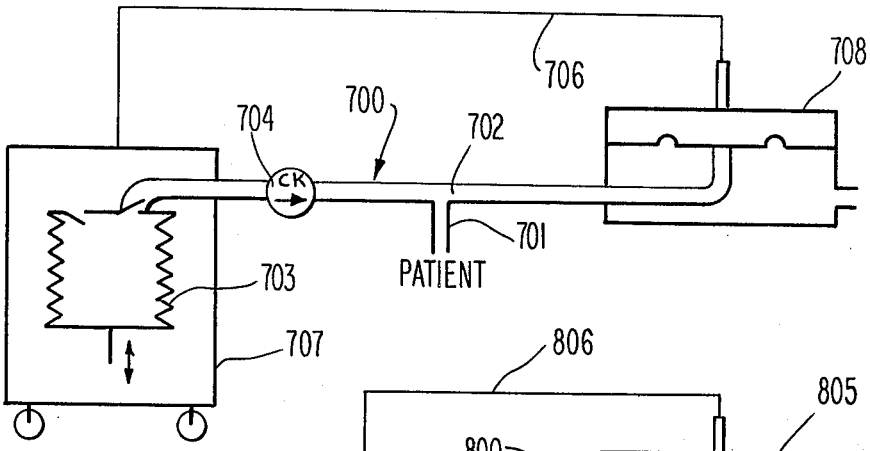
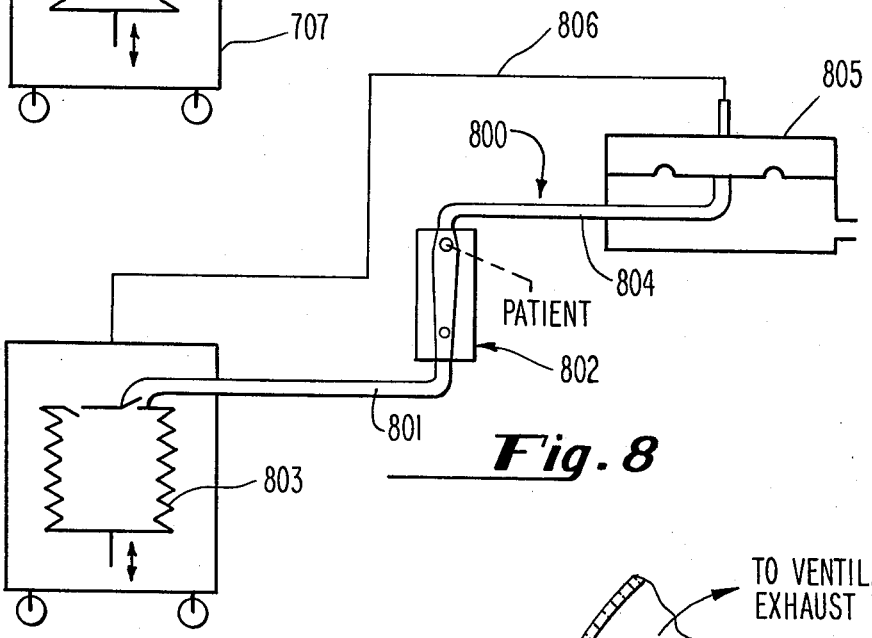
Fig. 8
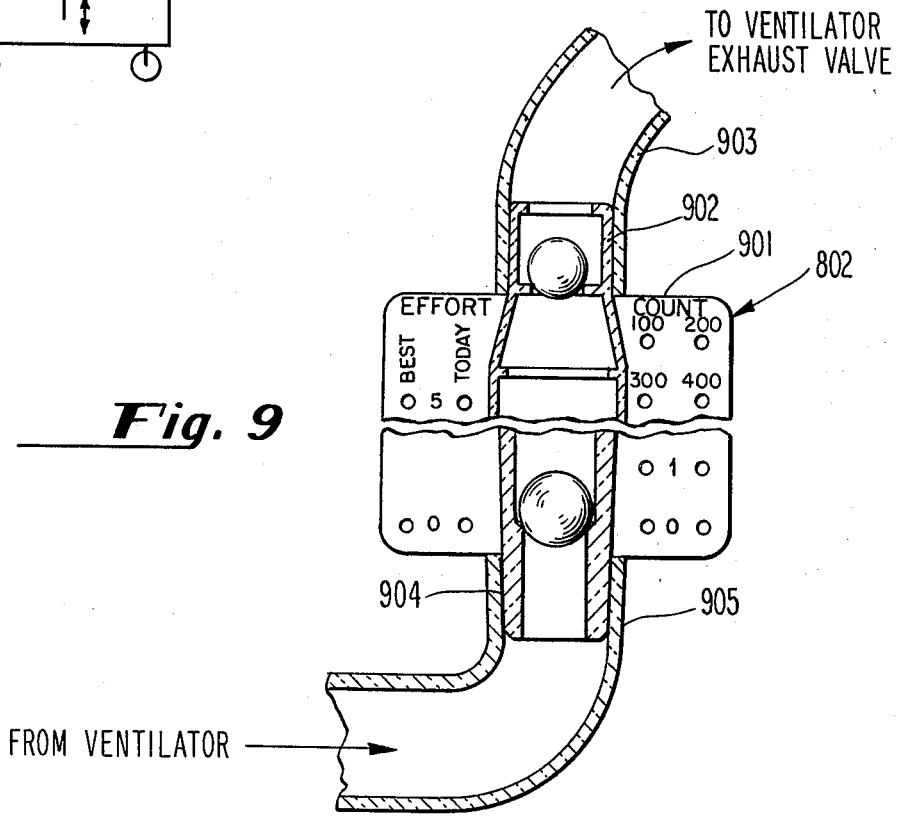
Fig. 9

PULMONARY EXERCISER

BACKGROUND OF THE INVENTION

This invention relates to pulmonary exerciser and preoperative and postoperative pulmonary evaluation devices, and more particularly, to pulmonary exercisers operative during both the inhalation and exhalation pulmonary cycles which incorporate quantitative scales and recording devices. These devices incorporate patient incentive features and are designed to motivate the patient to exercise.

Pulmonary exercisers are useful both pre and postoperatively, to help strengthen respiratory musculature, to help restore and maintain lung capacity, to motivate deep breathing, to help clean the lungs during the hospital stays. Further, pulmonary exercisers help prevent postoperative pulmonary complications such as atelectasis or hypostatic pneumonia. For example, periodic deep breathing exercises have been shown to be clinically useful for patients experiencing post surgical pain, inactive, obese, and geriatric patients, and patients with chronic obstructive pulmonary disease.

In view of the extensive utility of pulmonary exercisers, it is a primary object of the present invention to provide an exerciser apparatus which is relatively simple, lightweight, convenient to use, safe and inexpensive, whereby it is available to a relative maximum number of patients.

It is another object of this invention to accomplish the above object by allowing for both inspirator and expiratory exercise with a single unit.

Several types of exercisers are presently available. For example, one class of exerciser is based chiefly on the inspiratory stage of the pulmonary cycle, and includes utilization of bellows, blow bottles, or balls rising in columns. In the latter category, one or more sequential, interconnected columns have free access to the atmosphere at one low extremity, and balls located therein are pulled upwardly therefrom and suspended in the column by the suction effect of the inspiratory flow.

In a second class of exerciser, calibrated resistance is applied to the expiratory force of the patient. An example of this class of apparatus is set forth in U.S. Pat. No. 3,908,987 of J. R. Boehringer, issued Sept. 30, 1975.

In a third class of exerciser, the patient is asked to breathe against a relatively high resistance to expiratory flow contained in a cardboard tube.

In a fourth class of exerciser, the patient is asked to blow water from one bottle to another. This system has serious defects. The water itself may become an infection site, and in any event, this form of exerciser tends to drive the lung alveoli down to low volumes, whereas alveolar expansion also is desired.

It is an object of the present invention to provide apparatus capable of providing both inspiratory and expiratory exercise functions as well as quantifying inspiratory flow rate for certain clinical measurements and records. Correspondingly, in order to avoid danger to the patient, it is an object to provide such dual function without jeopardy to the safety of the patient. In order to minimize the training problem of alternate mouth and nose breathing, it is an object to combine inspiration flow measurement and positive end expiratory pressure (PEEP) connected to the patient by a common channel.

Another problem associated with postoperative exercisers is one which is generally associated with exercise and exercising apparatus: lack of motivation on the part of the user. That is, in nearly all exercise programs, faithful adherence tends to be discouraged by the nature of the exercise program, including the need to monitor repetitions of the exercise, and general inability to monitor the efficiency at which the exercise program is conducted. For pulmonary exercisers, discouragement also is provided in the form of discomfort associated with deep breathing by a patient who has had his chest surgically invaded. In any exercise program, lack of diligence is an undesirable situation, but for a failure diligently to follow a postoperative pulmonary exercise program, the results may be deleterious to the health, recovery, and even life of the patient.

It is accordingly an object of the present invention to provide postoperative apparatus which provides incentive motivation for the patient, whereby repetitive procedures and the efficiency of those procedures may be readily monitored.

It is another object of this invention to provide a pulmonary aid apparatus adapted for both inspiratory and expiratory breathing, with an indicator for providing visual measurement, and with facility for recording.

It is a further object of this invention to provide an inspiratory breathing apparatus with any means for measuring flow, and with a dual recording means, for recording both achievement level, and number of exercises.

It is another object of this invention to provide an inspiratory breathing apparatus that allows continuous measurement of level of achievement (as distinguished from mere measurements of whether or not a level of inspiration has been effected), along with any type of recording of any of various parameters associated with the breathing.

It is still another object of this invention to provide a pulmonary aid apparatus having a demountable base for ease of assembly, disassembly, or packaging.

It is a further object of this invention to provide a flow meter with facility for measuring that is predicated upon visual discontinuities.

It is another object of this invention to provide an inspiratory breathing apparatus with a flow responsive member adapted to seal when there is not flow, in preferably seated engagement.

It is a further object of this invention to provide an expiratory exercise apparatus (PEEP), in which versatility is provided for adjusting the amount of exercise that a patient may get in a given breath.

Other objects and advantages of the present invention will be readily apparent to those skilled in the art from a reading of the following brief descriptions of the drawing figures, detailed descriptions of the preferred embodiments, and the appended claims.

SUMMARY OF THE INVENTION

One aspect of the present invention involves a dual operation inspiratory expiratory pulmonary exerciser, with integrally contained valves whereby the inhalation flow is utilized to draw upon a float in a column, and wherein the exhalation flow is redirected through a positive end expiratory pressure device. In certain forms of the invention, indicia are provided in direct association with the exercise apparatus whereby the patient can quantify his status. In some forms of the invention, incentive motivation for continuing the program is provded by visual displays of his current versus preoperative status and of the number of times he has performed his exercise. In addition, recording devices and charting means are provided with the exercise to display the current progress versus a preoperation baseline or norm, in certain embodiments of the invention. In this way, the patient has a constant easily accepted norm to aim for, namely, his preoperative condition. As he advances through the exercise program he can see tangible evidence of improvement back to his own norm.

In an illustrative embodiment, an elongated, generally vertical column is divided into upper and lower segments, each of which carries a ball. The patient pulmonary system is coupled to an intermediate point between the segments, and the upper and lower extremities of the column are open to the atmosphere. During inhalation, the top ball automatically acts as a valve and blocks the expiratory path, and the lower ball rises in its associated segment in proportion to the inspiratory flow rate. During exhalation, the lower ball automatically acts as a valve and blocks its associated inlet at the bottom of the lower segment, and the upper ball is raised in its column, thereby opening its associated top segment to the atmosphere. The weight of the upper ball and diameter of the orifice determine the PEEP (positive end expiratory pressure).

In some prior art inhalation devices, the inhalation balls are not seated at zero flow but are held up by stops in their respective flow tubes. Thus any attempt to add PEEP to these configurations cannot be successful without additional valving to cut off these channels during expiration. In a preferred embodiment of the present invention, the lower float or ball is sealably seated at the bottom of its associated segment, and thereby is capable of registering even miniscule inspiratory flow rates. Such a device is also amenable to incorporate of separate valving to isolate the inspiratory flow side from the expiratory peep side.

One of the great cost saving features of such a device is the use of the PEEP ball (or float) to serve as the back flow preventer valve during inspiration and the inspiratory ball (or float) to serve as the backflow preventer valve during expiration. This embodiment saves the rather significant cost of a safe flow control valve and provides all of these functions in a convenient hand held package which a sick patient has the best chance of managing himself.

In accordance with a preferred form of the manufacture of the present invention, precision ground balls and a keyed seat (tongue and groove keys between injection moldings) allows for precision assembly of the PEEP valve seat without exorbitant cost to the patient. In effect, there is produced a precision flow measurement and end expiratory pressure control device for less than half the cost of either of these functions when purchased separately even ignoring the associated valving and circuitry which would be needed to couple them together in a safe working circuit.

In another form of the present invention versatility is provided in adjusting the weight raised during patient expiration by changing the float.

BRIEF DESCRIPTIONS OF THE DRAWING FIGURES

FIGS. 1 and 2 show respective front and side views of an illustrative embodiment of the present invention;

FIGS. *3a* through *3c* show views of an alternative embodiment whereby the device may be adapted not only to combine inspiration and expiration, but also to either of those functions independently;

FIG. 7 shows in diagramatic view a known system for patient ventilation;

FIG. 8 shows a system like that of FIG. 7, but with a combination inspiratory-expiratory device in accordance with the present invention; and FIG. 9 is an illustration of a modified form of combined inspiratory-expiratory device for use in the system of FIG. 8.

DETAILED DESCRIPTIONS OF THE PREFERRED EMBODIMENTS

Figure 1:
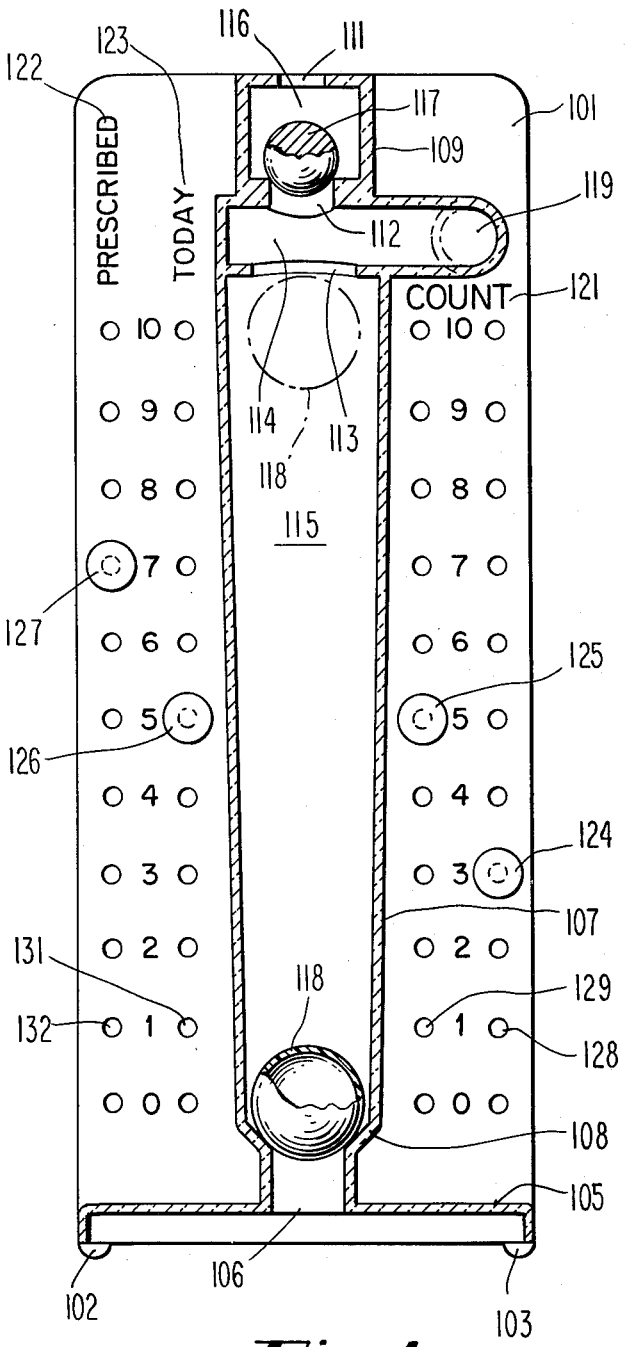
Figure 2:
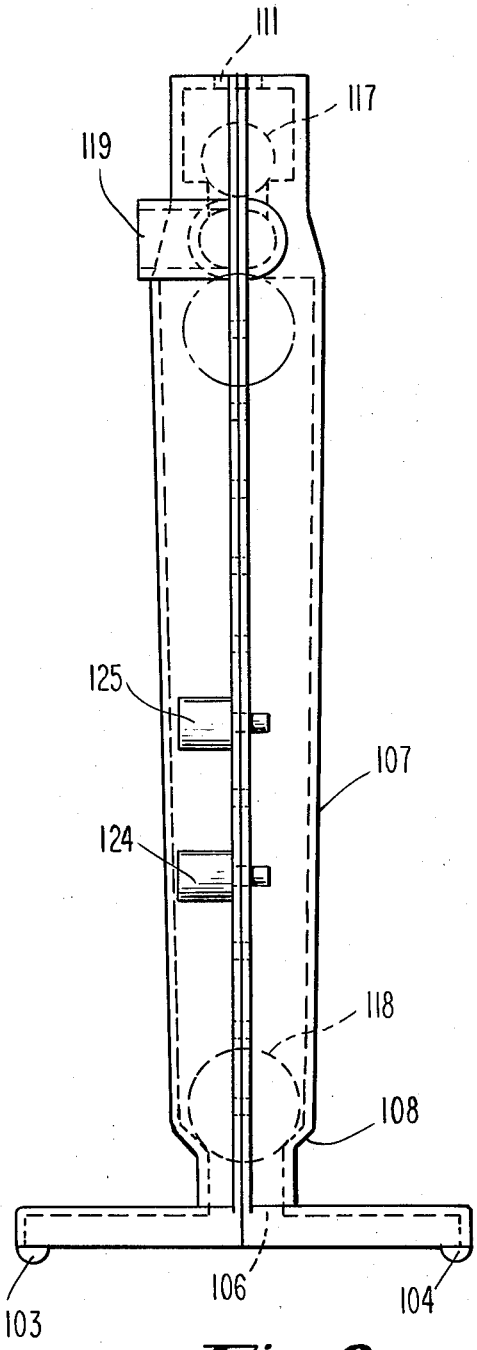
Figure 3A:
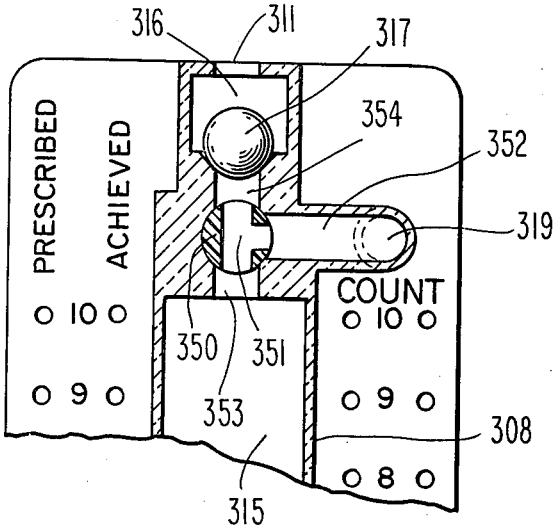
Figure 3B:
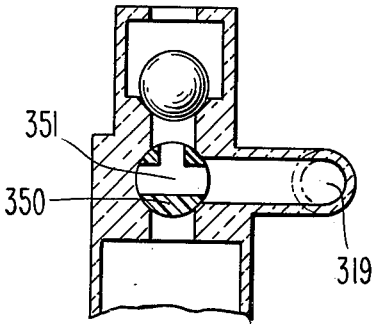
Figure 3C:
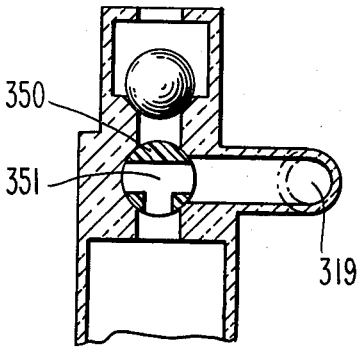

Referring first to FIGS. 1 and 2, there is shown a first illustrative embodiment of the present invention wherein an integral housing 101 defines the overall configuration of the device. An extended, generally vertical column therein is divided into respective lower and upper portions 107 and 109 at an intermediate area 114. Respective lower and upper chamber segments 115 and 116 are thereby defined. The patient pulmonary system is coupled to a dual inlet/exhaust port 119 opening into the intermediate portion 114. The lower extremity of the housing 101 defines hemispherical feet such as 102, 103, and 104 upon which the device rests, and a lower platform 105 thereabove defines an opening 106 to the atmosphere. The top portion of the upper segment 116 also defines an opening 111 to the atmosphere. Lower segment 107 of the column includes a tapered seat 108, upon which sits a movable member of the float type; preferably a ball 118 carried in the lower segment 115 of the chamber. Ball 118 rests on tapered seat 108 during patient exhalation, thereby occluding port 106.

A second member or ball 117 is carried in the upper chamber segment 116, which during quiescent conditions and during patient inhalation sits over an opening 112, thereby occluding air flow through opening 112 and out via chamber segment 116 and outlet port 111.

Lower chamber segment 115 is generally open to the intermediate portion 114, but lower portion 107 defines a non-round constriction 13 whereby the lower ball 118 is prevented from rising upwardly to block opening 112.

As noted in the drawings, the upper ball 117 is solid, made of heavier specific gravity material such as aluminum, and of relatively small diameter with respect to that of the chamber 116, whereas the lower ball 118 is of larger diameter relative to its corresponding chamber 115 and made of lighter specific gravity material such as polypropylene. Hence, the upper ball 117 is relatively heavy and the lower ball 118 relatively light (i.e., hollow or solid but of low specific gravity material). These dimensional and density parameters are selected in view of the nature of the forces imposed upon the ball. This is, the upper ball 117 provides a deadweight force against an orifice to generate PEEP (positive end expiratory pressure), whereas the lower ball 118 is drawn by the force of inspiratory flow to rise up the tube.

Figure 4:
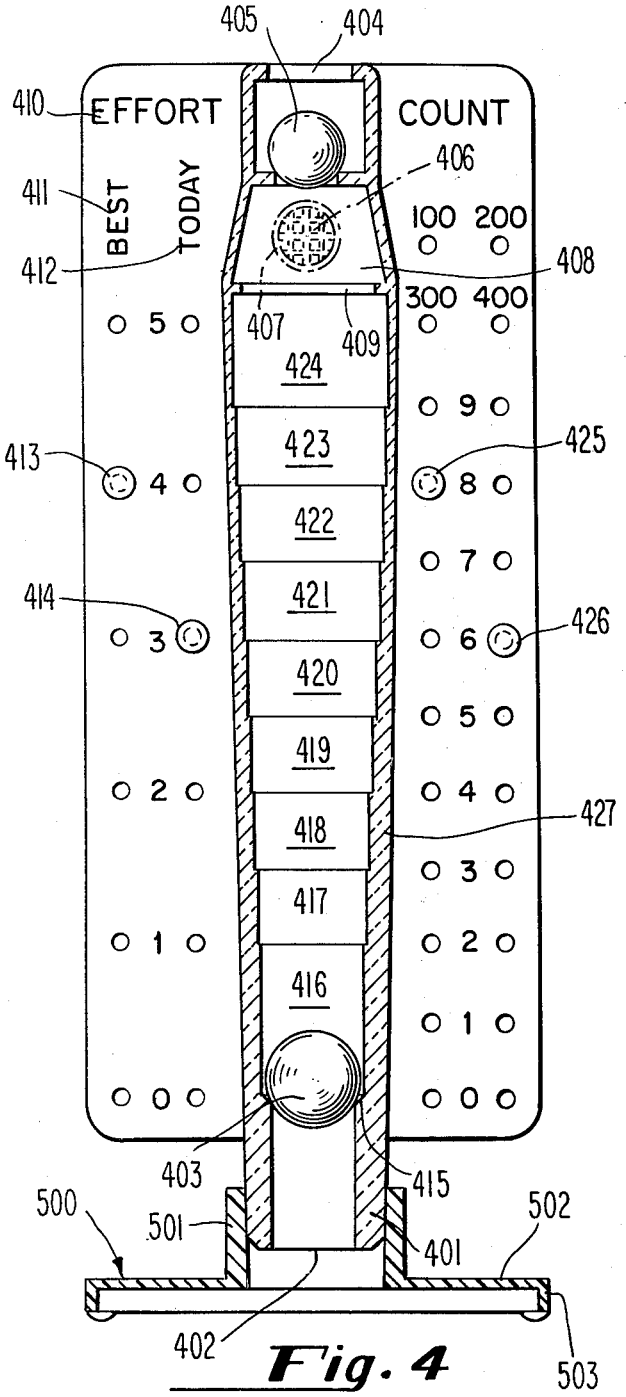
FIGS. 4 and 5 show respective front and side views of another illustrative embodiment.
Figure 5:
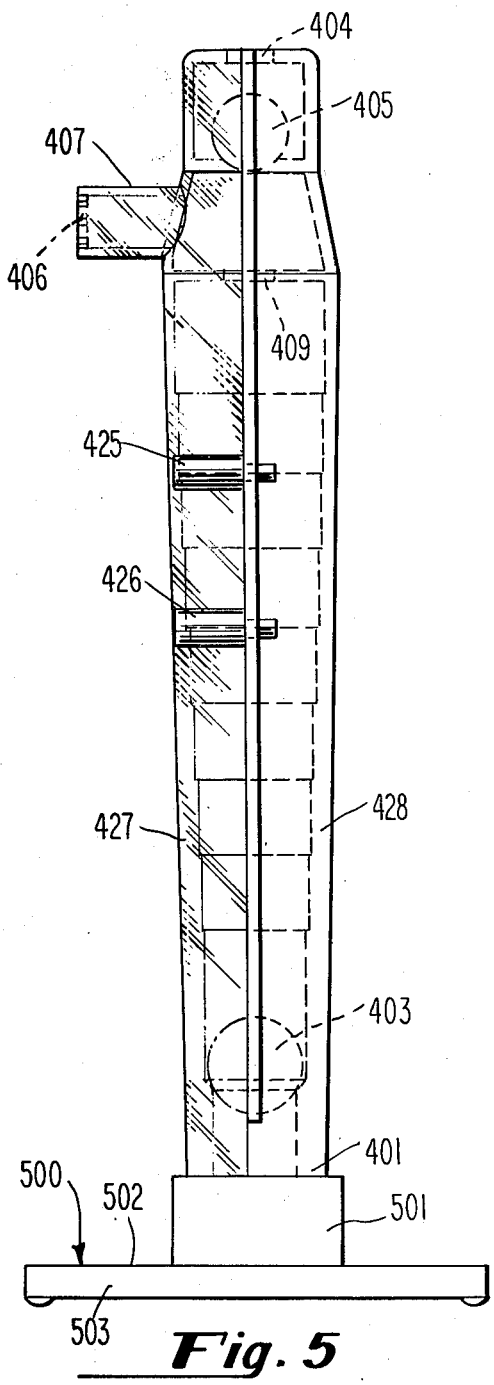

The lower ball 118 rises to a height in its associated segment 115 in a manner proportional to inspiratory air flow. As shown, the lower portion 107 tapers upwardly to an increasingly greater diameter between the lower seat 108 and the upper constriction 113. Variable flow calibration is thereby permitted, since the tapering walls 107 provide an increasing free space around the ball 118 with increasing height in the chamber 115. Note that phantom representation of ball 118 at the top portion of its associated segment 115. It will be appreciated that the walls 117 may be stepped radially outward between a narrower portion at seat 108, and the broader portion at constriction 113. Such an embodiment is shown in FIGS. 4 and 5, and discussed hereinafter. A conventional straight cylinder configuration for walls 107 may be utilized for flow indication only.

The housing 101 carries separate scales 121 for repetition counting, 122 for prescribed (e.g., previous best achieved or the preoperative baseline achievement) flow measurement inspiratory flow, and 123 for today's achieved inspiratory flow rate, thus providing a comparison of postoperative progress with preoperative condition. Separate vertical scales provide calibration indicia for the count scale 121 and the flow scales 122 and 123. Adjacent the scaling indicia (i.e., nominal levels "0" through "10") are series of holes such as 124, 125, 126, and 127. Optionally, sliders, slots, or tracks may be provided for the user to indicate level of achievement.

The pegs 124 and 125 provide double digit counting capacity in correspondence with the counting indicia scale 121. The peg 127 may be preset at the best preoperative achieved flow rate by the supervising doctor or nurse. In operation thereafter, the patient manipulates the peg 126 along the "today" flow scale 123, to the maximum extent that the patient has most recently raised the inspiratory ball 118. For each inhalation-exhalation cycle, the counting pegs 124 and 125 are appropriately incremented, and as appropriate, the "today" peg 126 may also be moved, thus giving a visible record or display of progress toward the preoperative condition and of the number of actual exercise inspirations that have been accomplished.

In operation, during inhalation, the lungs are under a slight negative pressure imposed by the lifting of the lower ball 118, possibly enhancing blood flow into the pleural cavity. During exhalation, PEEP (positive end expiratory pressure) is impressed on the lung by the deadweight ball 117 rising from its seat at 112 and maintaining pressure, depending on the specific gravity and diameter of the ball 117, the diameter of the seat opening 112, and the angle of inclination of the axis of the device. In accordance with one theory, this exhalation pressure helps to force blood from the pleural cavity and thereby may enhance blood flow throughout the body. Additionally, the functional residual capacity of the lung is clinically known to be maintained or increased by positive end expiratory pressure.

As shown, the embodiment of FIGS. 1 and 2 has the balls 117 and 118 carried in generally vertical columns; it will be understood, however, that the columns may be inclined to a desired degree, thereby lessening the imposed pressure effects upon the pulmonary system of the user.

In accordance with the principles of the present invention, the patient utilizing the device generally will breathe in and out through the same mouth piece without removing it from the mouth. This is in contrast to most prior art devices which, in addition to their limitations of single function (inspiratory or expiratory, but not both), require the patient either to remove the device between one half of the cycle and the other, or to redirect breathing from mouth to nose, selectively. Both the removal and redirected breathing procedures have been found to be clinically undesirable and very difficult to train patients to accomplish. People tend either to be nose breathers or mouth breathers, and when invalided, they do not readily change from one to the other mode of breathing, twice during each breath.

In a preferred embodiment of the present invention, the entire apparatus is of a transparent material, and in an alternative form, the front tubular portions 107 and 109 are transparent, whereas the remainder of the housing 101 may be opaque, translucent or colored as desired. The essential function of the transparency is to permit quantitative measurement of inspiratory flow and to provide the incentive motivation in accordance with the "prescribed" and "today" scales 122 and 123.

As in the aforementioned patent of John R. Boehringer, the specific gravity of the ball, and diameter of orifice and channel regulates flow pressure and ball position.

Also as in the aforementioned patent of John R. Boehringer, ball/seat relationship is provided at 108 and 112 which will seal but not jam because the seat angle exceeds the angle of repose for the combination of the materials of ball and seat. This ball/seat relationship also functions as an inherently safe back flow preventer.

FIGS. *3a* through *3c* show an alternative embodiment of the present invention, wherein the dual inspiratory-expiratory function of FIGS. 1 and 2 may be realized, or alternatively the device may be utilized solely for inspiration or expiration. In the figures, the upper chamber 316 which carries the dead-weight ball 317 and the lower segment 315, which carries the lower, inspiratory ball (not shown) are connected by a vertical channel 353 and 354. A transverse channel 352 couples the patient via 319 to the channel 353 and 354. At the confluence of channels 352, 353, and 354 is a pivotable, cylindrical element 350, which defines a "T" opening 351 therein, which effectively duplicates the configuration of channels 352, 353, and 354. The pivotable element 350 functions as a valve for channeling air flow within and between the channels 352, 353, and 354, and thereby between the patient via 319, the lower inspiratory segment 315 via channel 353, and the upper expiratory segment 316 via channel 354. As shown in FIG. *3a*, valve 350 is positioned for dual inspiratory and expiratory operation. When pivoted as shown in FIG. *3b*, the inspiratory channel is blocked, and the apparatus is conditioned only for positive end expiratory pressure. When the valve 350 is pivoted as shown in FIG. *3c*, the apparatus is conditioned for operation only in the inspiratory mode of operation.

FIGS. 4 and 5 show an alternative embodiment of the present invention, utilizing a sequential, incrementally tapered chamber for the inspiratory flow aspect. In FIGS. 4 and 5, a transparent front portion 427 and a rear portion 428 form a generally vertical column between an inlet port at the lower extremity 402 and an outlet port top extremity 404. Like the foregoing embodiments, the embodiment of FIGS. 4 and 5 involves a lower chamber containing a ball 403 for inspiratory flow purposes, and an upper chamber containing a ball 405 for positive end expiratory pressure purposes. A central segment 408 is the point of application of a patient pulmonary system, and to that end, a protuberance 407 extends directly outward and includes an integrally molded screen section 406. A flexible hose is fitted over the protuberance 407 and extended to the patient; the screen 406 acts as a filter to prevent foreign matter from leaving the chamber 408 and entering the patient's lungs.

As in the previous embodiments, the lower, or inspiratory ball 403 rests during quiescent condition upon a sloping seat 415. Above the seat is the chamber in which the ball 403 is raised during inspiration. The previously described embodiment employed a gradually tapering chamber, but the embodiment of FIGS. 4 and 5 is graded in sequential segments 416 through 424 of steadily increasing diameter between the seat 415 and the vent 409 between the inspiratory chamber and the intermediate segment 408. This sequential stepped structure is very significant, in that it allows for clear, discrete readings of the degree in which the ball 403 is raised during inspiration. That is, in accordance with the embodiment of FIGS. 4 and 5, during inspiration, the ball 403 in a stable, steady-state flow position 416 through 424 depending upon the inspiratory capability of the user. For a given inspiratory flow, the ball 403 will rise up into an associated one of the segments 416 through 424, and assume a position within that segment until the inspiratory flow changes. Hence, the greater the inspiratory flow, the higher the ball 403 will ride in the column 427, at a particular, discrete one of the segments 416 through 424.

In clinical practice, it is generally desired that an inspiratory cycle be conducted for the range of three seconds. The embodiment of FIGS. 4 and 5 promotes this end, in that when inspiratory force is first applied to the ball 403, it will be raised up into the column 427 by a certain degree, generally overshooting by a small amount the segment 416 through 424 at which stable flow conditions will result; very shortly thereafter the ball will ease back onto a segment 416 through 424 which yields a stable ball position losing readout by the patient and promoting accuracy of reading, even though the device being used is one normally suited for steady-state flow conditions as a transient flow readout.

In accordance with the embodiment of FIGS. 4 and 5, the lowest segment 416, combined with the valve seat structure 415, insures that even a minimal flow will raise the ball slightly into the segment 416, thereby providing an accurate vernier even for clinically very low inspiratory flow rates.

The stepped diameters between the segments 416 through 424 also provide optical index lines which correspond to the achieved flow level. That is, on a flange to the one side of the inspiratory column 427 are scale indicia 410, designated "effort", which in turn are divided into separate scales for "best" 411 and "today" 412. As in the previous embodiment, the scales 411 and 412 include separate designations alongside the inspiratory column 427, and pegs 413 and 414 may be utilized respectively to indicate preoperative and most recent postoperative inspiratory conditions. In accordance with the embodiment of FIGS. 4 and 5, however, the optical index lines constituting the stepped diameters allow the user correctly to sight the achieved height of ball 403 against the scales 411 and 412. This, of course, is further aided by the positional stability of the ball 403 in one of the segments 416 through 424 in correspondence with the associated inspiratory condition of the user.

The steps between segments 416 through 424 have the optical property of establishing reference lines as fine as the hairs in a telescopic sight, but by a very inexpensive process. The nature of the lines circumferentially around the chamber avoid the problem of parallax because each line may be oriented in the field of the user's vision to appear as a line, rather than as an ellipse. The ball will stabilize right at the juncture of the widening of the diameter, thus providing an easily read device.

By machining the segments 416 through 424 to close clearances, the lowest segment 416 can as set forth hereinbefore be attuned to raise the ball even on the most minor inspiratory forces, such as that of a child's breathing postoperatively. By utilizing large clearances between the ball 403 and the column 427 in the top regions such as 422 through 424, even a healthy adult is challenged to raise the ball 403 all the way up. Such flow ranges are generally not achievable to prior art devices employing uniform top to bottom diameter.

Another distinction between the embodiment of FIGS. 4 and 5 and the previously disclosed embodiment of FIGS. 1 and 2 relates to the lower section. That is, the embodiment of FIGS. 4 and 5 employs a lower fitting 401 about the inlet port 402 thereby the device may be connected to a source of oxygen or humidified air, as is clinically useful for those patients who must be on a source of air other than room air. Furthermore, the embodiment of FIGS. 4 and 5 may advantageously be interconnected at top and bottom to a patient's ventilating system, whereby the patient has mechanical aid to breathing, as is described more fully hereinafter, with particular reference to FIG. 8.

The tapered lower fitting 401 allows further for a removeable base member 500 to be provided for the embodiment illustrated in FIGS. 4 and 5, comprising a generally transverse supporting portion 502, having feet 503 similar to those 102, 103 of FIG. 1, and having a generally upstanding neck 501 sized to receive the lower end portion or fitting 401 of the device, in readily connectable and disconnectable fashion. The internal size and configuration of the neck portion 501 is constructed to complementally receive the lower end of the column 427 as shown in FIG. 4, and may be provided with any suitable snap or detene type lock (not shown) as is desired. There is particular advantage in providing a readily attachable and detachable base member 500, not only from the standpoint of minimizing package size by shipping the apparatus in disassembled condition, but also in providing an apparatus that is adaptable to be used by a patient, on a table, nightstand or the like, but which is also adaptable to have the base member 500 disconnected from the remainder of the apparatus, for attachment of an oxygen tube, moist air tube, or the like at end 401.

The embodiment of FIGS. 4 and 5 employs a more extensive count scale than did the embodiment of FIGS. 1 and 2, in this case by utilizing a count as large as 499 repetitions.

Figure 6:
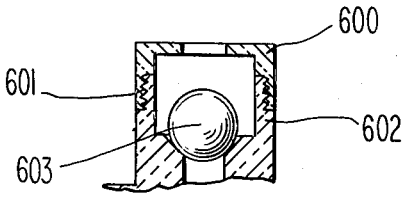
FIG. 6 shows in fragmentary cross section, an expiration excercise device in which the ball can readily be changed to accommodate different balls of different weights.

In an alternative embodiment, the positive end expiratory pressure aspect embodied by ball 405 may be removed, and plugged or the ball may be lightened up significantly (Sp. Grav. = 1.1 or less) as with polypropylene, thereby yielding a device useful for inspiratory pulmonary cycles only. In this regard, a modification is illustrated in FIG. 6, showing a removeable end cap 600, threadably connected at 601 to the upper neck portion 602 of the positive end expiratory pressure portion of the apparatus. This provides an additional variation in the device, whereby balls 603 of various weights may be employed, depending upon the lung capacity of the patient. For some patients, a heavier ball may provide the desired resistance to expiratory breathing, and for others, a lighter ball may be used. Another benefit residing in this feature of the present invention exists in the ability of a physician to prescribe different ball weights as a patient's lungs change in ability with treatment. The remainder of the apparatus illustrated in FIG. 6 may be constructed in accordance with any of the other embodiments shown in the various other drawing figures.

Referring now to FIG. 7 in detail, a patient's ventilation system 700, is illustrated diagrammatically, in which a patient is connected to the system via 701 that, in turn, is connected to line 702 that receives air from a pump 703, through a check valve 704, with the valve 704 functioning such that inspiratory air from the pump 703 passes the valve 704 to the patient, but that, upon expiration, the patient exhales, and exhausts through an exhaust valve 708 of diaphragm 705 type. A signal line 706 is provided, whereby the bellows type pump 703 is operated to deliver air to the patient if it is desired that the lungs of the patient be inflated, and with the line 706 transmitting a signal to the pump 703, to deactivate the pump 703, when it is detected that the patient is exhaling. Conventionally, the pump 703 is provided in a self-contained unit 707, that employs the customary motor, vent, and which preferably is of a portable type, such as for example, of a wheel mounted type. Similarly, the exhaust valve 708 may likewise be portable. Such systems may be used not only to pump ambient air to a patient, but also oxygen, or any desired mixture or modification thereof. Another alternative would be to supply moist air to a patient, if the same was desired.

In FIG. 8, a similar system to that of FIG. 7 is shown, whereby the air-oxygen mixture, moist air, or the like, is delivered from the pump 803, through the line 801, to a combination inspiratory-expiratory device 802 in accordance with the present invention, for expiration by the patient through line 804 to an exhaust valve 805, that can likewise activate or deactivate the pump 803 by means of a suitable control line 806. It will be understood that the control lines 706 and 806 are schematically illustrated, and may employ any desirable circuitry or the like, responsive to the patient's exhalation for stopping and starting the pump, as desired.

In accordance with the device of the present invention, it will be understood that a patient hooked up to the device 802, may employ the ventilation system in different ways. If the prescribing physician has desired that a patient exercise his lungs for a prescribed period, the system may be automatically set up to, in effect, breathe for the patient for a number of breaths, and to then automatically deactivate, such that the patient draws inspiratory breaths through the device, while the pump 803 is deactivated, and then exhales such breaths. After a given number of such exercises, the automatic venitlation system can resume operation. Another use for a system such as that of FIG. 8, would be one in which the ventilation system is set up to work on demand only, in an instance in which spontaneous inspiratory breathing through the device of the tube did not take place within the passage of a desired predetermined number of seconds.

With reference to FIG. 9, it will be seen that a device 802 is provided, that may be constructed like any of the devices of FIGS. 1 through 5, but in which the housing 901 has a shortened upper edge, as indicated in FIG. 9, to allow protrusion of the exhalation discharge portion 902 thereabove, for connection of exhaust valve tubing 903 or the like thereabout. The lower end 904 is tapered externally similar to the taper of the device of FIGS. 4 and 5, for connection of tubing 905 from the ventilator line 801. This provides a device 802 that is readily connectable to, and disconnectable from the ventilation system of FIG. 8, and which permits exercise with all of the features discussed above for the device in accordance with the present invention.

It will be apparent that in the system of FIG. 8, employing a device such as that of FIG. 9, the devices of this invention lend themselves to their being coupled in circuit fashion, as indicated in FIG. 8, to the various types of patient ventilating systems. One such system would be a ventilator that has a purpose assisting the patient to wean himself away from dependency on the ventilator, with such weaning being provided by the device 802 in accordance with the present invention. Another type of system would be that that is known in the art as an intermittent mandatory ventilator, that provides ventilation in accordance with a predetermined sequence. Still another type of ventilation is provided in the apparatus that is known in the art as intermittent positive pressure breathing apparatus. It will be apparent that various types of systems are adaptable for employing devices such as the device 802 in accordance with the present invention.

It is to be understood that the foregoing has set forth preferred and illustrative embodiments of the present invention, but that numerous alternative embodiments will occur to those of ordinary skill in the art without departure from the spirit or the scope of the present invention.

We claim:

1. Spirometer apparatus comprising:

(a) housing means including integral, operatively associated, alternately effectuated closable openings for inspiratory flow responsive and expiratory pressure means associated therewith;

(b) indicating means, associated with said inspiratory flow means, for quantifying the inspiratory pulmonary condition of the user; and (c) said expiratory pressure means being of the positive end expiratory pressure type employing a deadweight force means operative against one of said openings in resistance to expiratory flow through the orifice.

2. A pulmonary exerciser comprising:

a housing defining a generally vertical, elongated tubular chamber therein, having ports opening to the atmosphere at end portions thereof, and being divided into respective upper and lower segments at an intermediate region, said upper segment defining a communication passageway to said segment at said intermediate region;

means for coupling a patient's pulmonary system to said chamber at said communication passageway;

first passageway blocking means carried in said upper segment, resting over and blocking said passageway during patient inspiration, and being carried above said passageway in said upper segment by the pressure and flow of patient expiration; and a second passageway blocking means carried in said lower segment, resting on and blocking said bottom port during patient expiration, and being carried above said bottom port by the pressure and flow of patient inspiration.

3. An exerciser as described in claim 2, wherein said first and second passageway blocking means are first and second balls respectively and wherein said housing includes transparent materials defining said lower segment, thereby exposing the position of said second ball to the view of the patient, and wherein said exerciser further includes indicia along said lower segment for evaluation of the extent of travel of said second ball in said lower segment.

4. An exerciser as described in claim 3, and further comprising a lateral extension alongside said lower portion, and marker means, positionable in association with said indicia, for establishing inspiratory goals for the patient, said extension carrying said marker means alongside said lower segment.

5. An exerciser as described in claim 4, and further comprising accumulator means, operable by the patient, for maintaining an interative count of successive inspiratory-expiratory cycles.

6. Apparatus as described in claim 2, wherein said bottom port has means for connection with a source of oxygen of the patient.

7. Apparatus as described in claim 2, wherein said means for coupling includes integral filter means in the flow path between the user and said communication passageway.

8. The exerciser as described in claim 2, including valve means of the mutually actuable type at said communication passageway for optional flow connection between said coupling means and one of:

(a) said upper segment;

(b) said lower segment;

(c) both said upper and lower segments.

9. The apparatus of claim 2, wherein opening means is provided to said first passageway blocking means, for opening said upper segment for removal and replacement of said first passageway blocking means.

10. The apparatus of claim 9, wherein said opening means is of the threaded end cap type.

* * * * *

UNITED STATES PATENT OFFICE

CERTIFICATE OF CORRECTION

Patent No. 4,231,375 Dated November 4, 1980

Inventor(s) John R. Boehringer and John H. Lecky

It is certified that error appears in the above-identified patent and that said Letters Patent are hereby corrected as shown below:

Column 1, Line 31, "inspirator" should be --inspiratory--.

Column 3, Line 48, "the" should be deleted.

Column 5, Line 4, "that" should be --the--.

Column 8, Line 41, "detene" should be --detente--.

Column 9, Line 34, "air-oxygen" should be --air, air-oxygen--.

Column 10, Line 53, "said segment" should be --said lower segment--.

Signed and Sealed this

Sixteenth Day of June 1981

[SEAL]

Attest:

RENE D. TEGTMEYER

Attesting Officer

Acting Commissioner of Patents and Trademarks